United States Patent [19]

Brandell

[11] Patent Number: 4,484,633

[45] Date of Patent: Nov. 27, 1984

[54] SAFETY JOINT

[75] Inventor: John T. Brandell, Duncan, Okla.

[73] Assignee: Halliburton Company, Duncan, Okla.

[21] Appl. No.: 484,079

[22] Filed: Apr. 11, 1983

[51] Int. Cl.[3] ..... F21B 31/00

[52] U.S. Cl. ..... 166/301; 166/63; 285/81

[58] Field of Search ..... 166/301, 297, 68, 68.5, 166/105, 376, 377; 285/2, 3, 4, 18, 81

[56] References Cited

U.S. PATENT DOCUMENTS 3,368,829 2/1968 Barrington et al. ..... 285/81
4,246,964 1/1981 Brandell ..... 166/187 X

OTHER PUBLICATIONS

Reduced size print entitled "3⅞" VR Safety Joint."
Reduced size print entitled "Safety Joint-RTTS 2⅞"."

*Primary Examiner*—Stephen J. Novosad
*Assistant Examiner*—Thuy M. Bui
*Attorney, Agent, or Firm*—Joseph A. Walkowski; Thomas R. Weaver

[57] ABSTRACT

A safety joint for use in a pipe string, particularly one incorporating testing tools, comprising a substantially tubular outer housing with an automatic J-slot cut into the interior surface thereof. A mandrel having a spline radially protruding therefrom along its upper longitudinal extent and a J-slot lug also protruding therefrom below the spline and to a greater radial extent is slidably contained within the housing and is initially prevented from sliding within it by a tension sleeve which is designed to part in response to a predetermined tensile force. To operate the safety joint, the pipe string is set down and right-hand torque applied, after which tension is applied to the pipe string until the tension sleeve parts, whereupon the mandrel moves upwardly with respect to the housing, the J-slot lug being constrained to follow the path of the J-slot. The right-hand torque and upward pipe string movement causes a mandrel retaining nut at the top of the housing to back off therefrom. This sequence is repeated until the nut is completely backed off, whereupon the mandrel will pull free from the housing and all of the string above the housing may be removed from the well bore.

20 Claims, 8 Drawing Figures

SAFETY JOINT

BACKGROUND OF THE INVENTION

Safety joints are in common use in the petroleum industry, the object being to provide a capability to retrieve as many stands as possible of a pipe string as well as any associated tools when pipe string becomes stuck in the well bore, a not uncommon occurrence during drilling and open hole testing.

Two prior art safety joints of conventional design are the Halliburton Services VR Safety Joint and Anchor Pipe Safety Joint, pictured and described at page 3999 of Halliburton Services Sales and Service Catalog Number 41. The VR Safety Joint is operated by reciprocating the pipe string up and down while maintaining right-hand torque. The pipe string reciprocation and right-hand torque backs off a left-hand exterior threaded nut within the housing, which nut prevents the mandrel of the safety joint from coming free from the housing during normal pipe string movement.

The Anchor Pipe Safety Joint is operated by neutralizing the weight of the pipe string at the location of the safety joint and rotating the pipe string to the right, which rotation backs off a left-hand exterior threaded nut within the housing.

Another prior art safety joint is the Halliburton Services RTTS Safety Joint, which operates in much the same manner as the aforementioned VR Safety Joint, utilizing right-hand torque and pipe string reciprocation. However, the RTTS Safety Joint includes a tension sleeve which must be parted by application of a predetermined tensile force on the pipe string before the tool can be operated by reciprocation.

While this and other prior art safety joints may be acceptable in some circumstances, there are occasions when the amount of right-hand torque which can be applied to a pipe string while reciprocating the string is limited by the ability of tools in the string to withstand the necessary torque, making the VR Safety Joint unusable. For example, in a testing string such as is disclosed in U.S. Pat. No. 4,246,964, issued to John T. Brandell and assigned to Halliburton Company, the use of the downhole rotary-actuated pump claimed therein precludes the use of continuous pipe string induced torque. The prior art safety joints are therefore deficient for such an application. Since such a downhole pump and associated components are valuable tools, it is not practical to run the string without a safety joint.

SUMMARY OF THE INVENTION

In contrast to the prior art, the safety joint of the present invention relies on reciprocation of the pipe string in conjunction with a fairly low level of right-hand torque on the downstroke of the string. The safety joint of the present invention comprises a substantially tubular housing having an automatic J-slot cut into its interior surface near its top end. A mandrel with an adapter at its top end and a radial spline along one side below the coupling is slidably mounted in the housing. Below the spline, a J-slot lug protrudes into the J-slot in the housing. At the bottom of the mandrel, a shearable tension sleeve maintains the mandrel in a contracted position within the housing. To operate the safety joint, the pipe string is set down, and right-hand torque applied, after which a predetermined amount of tension is applied to the pipe string, which shears the tension sleeve. The mandrel is prevented from totally withdrawing from the housing by an external left-hand threaded mandrel retaining nut engaged with internal left-hand threads at the top of the housing. The nut has a bore within which the mandrel may slide, and a keyway in which the mandrel spline is constrained. As the tension sleeve parts and the mandrel moves upward with respect to the housing, the mandrel J-slot lug engages the J-slot in the housing and applies torque to the nut. Since the threading engaging the nut to the housing is left-hand, the pipe string induced torque and the J-slot induced torque back off the nut one-half turn. The pipe string is then set down and the sequence is repeated until the nut is completely backed off, at which point the adapter, the mandrel and everything above them in the pipe string can be removed from the well bore. As the downhole pump previously referred to is mounted above the safety joint, it is easily retrieved with the rest of the string.

BRIEF DESCRIPTION OF THE DRAWINGS

The safety joint of the present invention will be better understood by reference to the following detailed description of the structure and operation of the preferred embodiment, taken in conjunction with the accompanying drawings, wherein.

DETAILED DESCRIPTION AND OPERATION OF THE PREFERRED EMBODIMENT

Figure 1A:
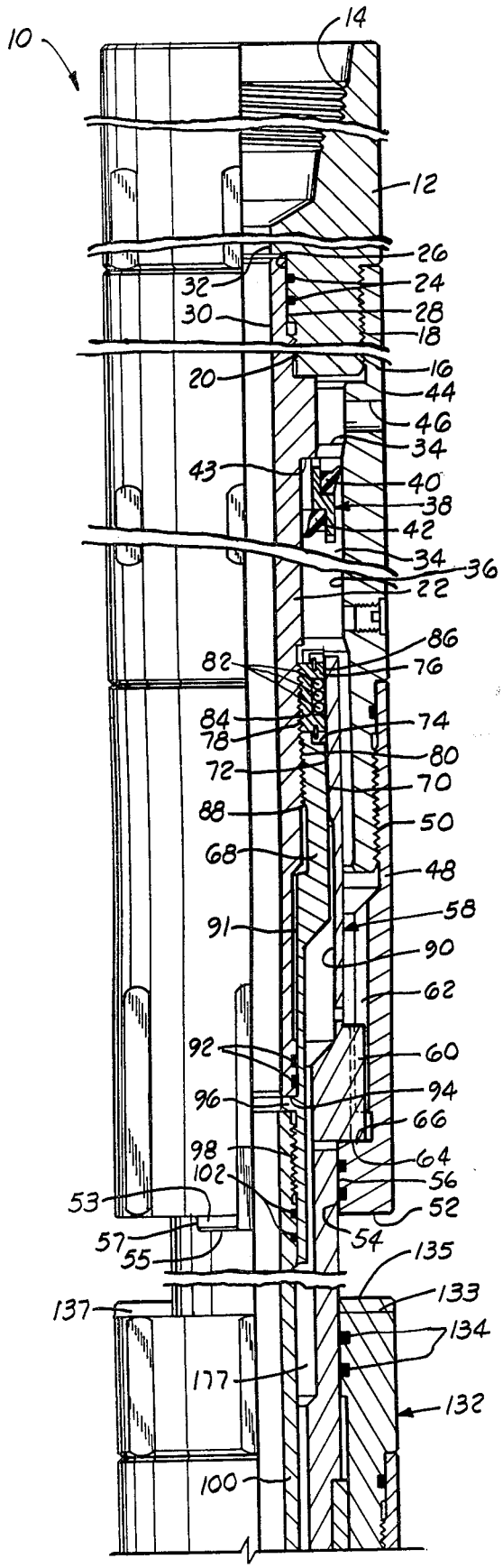
FIGS. 1A, 1B and 1C are sectional elevations of a rotary-actuated downhole pump as modified to operate with the safety joint of the present invention.
Figure 1B:
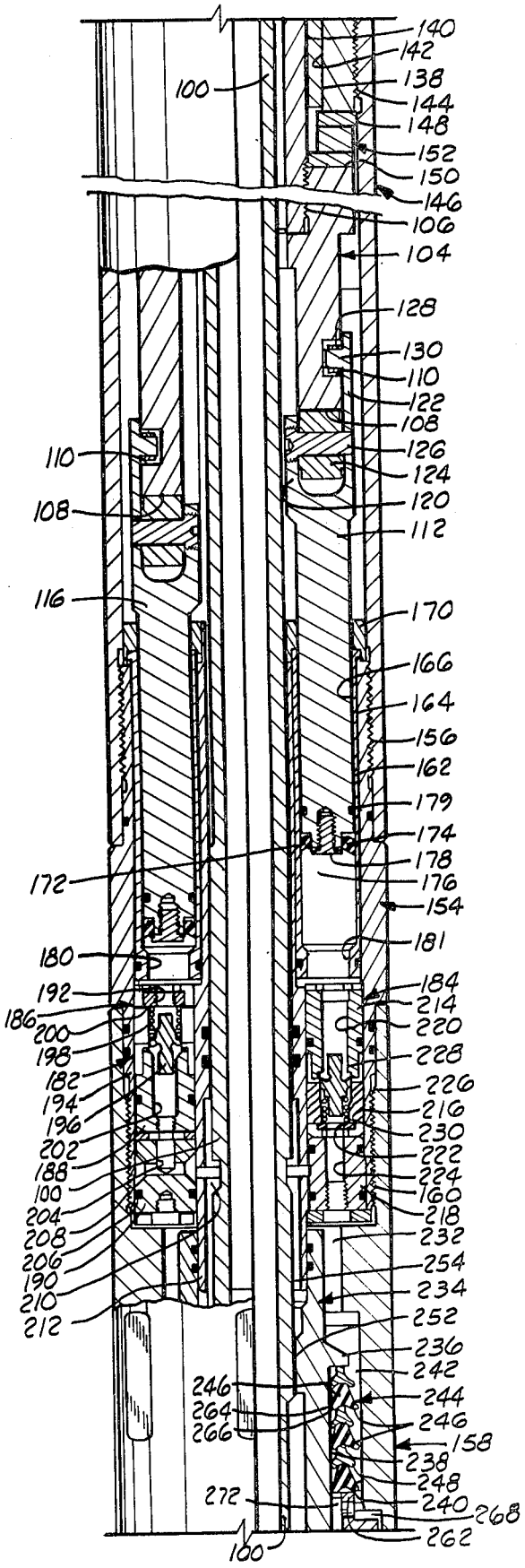
Figure 1:
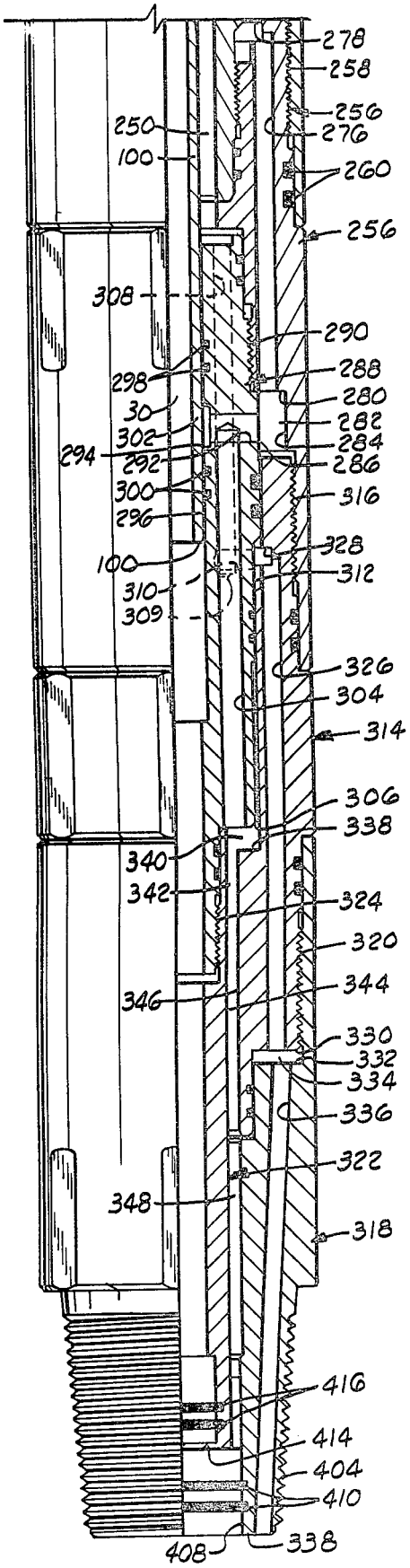
Figure 2:
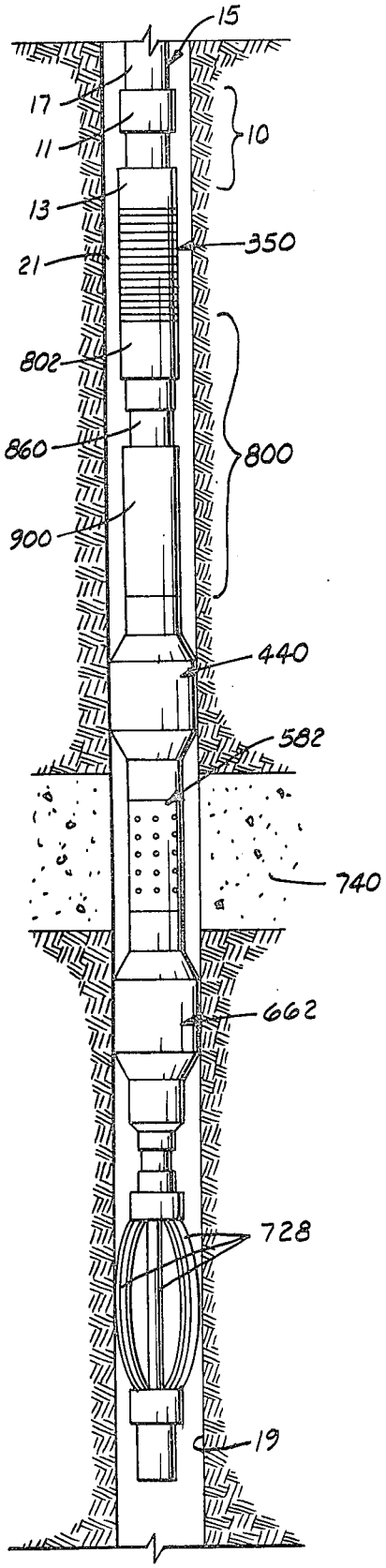
FIG. 2 is a schematic view of the safety joint of the present invention depicted as part of a testing string in a well bore, which testing string incorporates a rotary-actuated downhole pump as shown in detail in FIGS. 1A–1C.

Referring first to FIG. 2 of the drawings, a well testing assembly is shown in place at the end of pipe 17, which is a part of pipe string 15, the upper end of which is connected to a conventional drilling rig at the surface, and the lower end of which is connected to downhole pump assembly 10. Downhole pump assembly 10 includes an upper pump portion 11 and a lower pump portion 13, upper pump portion 11 and lower pump portion 13 being operably associated so that pump assembly 10 is operated on relative rotational movement therebetween. The downhole pump may be constructed in a manner similar to that shown in my U.S. Pat. No. 4,246,964, assigned to Halliburton Company and incorporated herein by reference. However, certain modifications to the above referenced pump should be made, as noted below in the description of drawing FIGS. 1A–1C.

When lower pump portion 13 is held fixed, and the upper pump portion 11 is rotated by rotation of pipe string 15, pump assembly 10 operates to pump well fluid under pressure. Connected to lower pump portion 13 is an intake screen assembly 350, through which well fluid (generally drilling mud) from well bore annulus 21 is drawn to the suction side of downhole pump assembly 10.

Connected to the lower end of screen assembly 350 is safety joint 800 of the present invention, of which is shown the exteriors of upper adapter 802, mandrel 860 and housing 900. The internal structure of safety joint 800 is detailed hereafter in the description of drawing FIGS. 3A–3C and 4. With respect to the normal operation of the well testing assembly shown in FIG. 2, safety joint 800 provides conduits therein for the passage of well fluids employed in inflating packers 440 and 662, and for the passage of formation fluids from formation 740 through intake port assembly 582 to pipe string 15.

It should be noted that a pressure limiter such as is described in my U.S. Pat. No. 4,313,495, assigned to Halliburton Company and incorporated herein by reference, may be employed in the well testing assembly, between screen assembly 350 and safety joint 800 of the present invention. The purpose and operation of a pressure limiter is described in the aforesaid U.S. Pat. No. 4,313,495.

Connected to the lower end of housing 900 of safety joint 800 is a first inflatable packer 440 and a second inflatable packer 662, which have a formation fluid intake port assembly 582 located therebetween adjacent subsurface producing formation 740, which is to be tested by the well testing assembly.

Located below inflatable packer 662 are drag springs 728, which engage wall 19 of the well bore to center and to prevent rotation of those well testing assembly components fixed thereto.

The general mode of operation of downhole pump assembly 10, and details of the structure, purpose and operation of screen assembly 350, inflatable packers 440 and 662, as well as intake port assembly 582 and drag springs 728 are described in the heretofore incorporated by reference U.S. Pat. No. 4,246,964. The numerals employed in the text of the present application to denote the various elements of the well testing assembly are the same as those employed in that patent, in order to facilitate reference to the detailed description set forth in the latter.

It is believed that a detailed description of the downhole pump assembly 10, as described in U.S. Pat. No. 4,246,964 with the present modifications is desirable for a complete understanding of the operation of safety joint 800 of the present invention. Accordingly, referring to FIGS. 1A–1C, downhole pump assembly 10 includes a top adapter 12 having an internal threaded bore 14 which provides a means for connecting the top adapter 12 to those portions of a pipe or drill string 15 (see FIG. 2), located above downhole pump assembly 10.

A lower end of top adapter 12 is threadedly connected to a torque adapter 16 at threaded connection 18 therebetween.

The lower end of top adapter 12 includes an internal threaded portion 20 by means of which top adapter 12 is threadedly connected to a ratchet mandrel 22. A fluid tight seal is provided between top adapter 12 and ratchet mandrel 22 by means of O-ring seals 24, disposed in annular grooves located on an inner cylindrical surface 26 of top adapter 12, and sealingly engaging an outer cylindrical surface 28 of ratchet mandrel 22. Ratchet mandrel 22 includes an internal bore 30 which communicates with an internal bore 32 of top adapter 12.

An annular cavity 34 is located between ratchet mandrel 22 and internal bore 36 of torque adapter 16. An annular floating seal means 38 is disposed within annular cavity 34 and includes upper and lower sealing rings 40 and 42 which provide fluid tight seals against torque adapter 16 and ratchet mandrel 22, respectively.

The outer surface of torque adapter 16 and the inner bore 36 of torque adapter 16, engaged by floating seal 38, may be referred to as radially inner and outer surfaces, respectively, of annular cavity 34. Floating seal 38 separates the well fluid in annular cavity 21 from a lubricating fluid located in annular cavity 34 between floating seal 38 and a torque mandrel 58.

Floating seal 38 is adapted for axial movement within cavity 34 when subjected to a differential pressure across floating seal 38 within cavity 34, as will be further explained below.

Fluid communication is provided between the upper end of cavity 34 and the annular cavity 21, by a relief port means 46. Torque adapter 16 includes an outer cylindrical surface 44 which is exposed to the well fluid in annular cavity 21.

Ratchet mandrel 22 includes a downward facing shoulder 43 projecting into annular cavity 34 for engaging floating seal 38 and limiting longitudinal movement of floating seal 38 toward relief port means 46. Upper sealing ring 40 provides a means for allowing a portion of the lubricating fluid located in annular cavity 34 to flow past floating seal 38 when torque mandrel 58 is moved longitudinally toward floating seal 38 after floating seal 38 is engaged with downward facing shoulder 43.

A lower end of torque adapter 16 is threadedly connected to a torque housing 48 at threaded connection 50. Torque housing 48 has radially inward extending flange 52 at its lower end which includes an internal bore 54 which closely receives an outer cylindrical surface 56 of torque mandrel 58.

Unlike the downhole pump shown in U.S. Pat. No. 4,246,964, flange 52 is not flat, but includes thereon a plurality of substantially identical downward extending lugs 53 spaced 180° apart and having flat tops 55 and longitudinally extending flat sides 57.

Torque mandrel 58 includes a plurality of radially outward protruding splines 60 which mesh with a plurality of radially inward extending splines 62 of torque housing 48 so that relative axial movement between torque housing 48 and torque mandrel 58 is allowed while relative rotational movement between torque housing 48 and torque mandrel 58 is prevented. Upward axial movement of torque housing 48 relative to torque mandrel 58 is limited by engagement of a downward facing shoulder 64 of torque mandrel 58 with an upward facing shoulder 66 of torque housing 48.

A ratchet case 68 includes an upper outer cylindrical surface 70 which is closely received within an upper inner cylindrical surface 72 of torque mandrel 58.

Ratchet case 68 includes a plurality of ratchet member cavities 74 disposed through ratchet case 68. Within each of the ratchet member cavities 74 is contained a ratchet block 76. Each of the ratchet blocks 76 includes an inner left-handed ratchet thread 78 which engages a left-hand threaded portion 80 of ratchet mandrel 22.

A plurality of endless elastic bands 82 are placed about ratchet case 68 and retained in outer grooves 84 of ratchet blocks 76. Each of the ratchet blocks 76 has a radially outer surface 86 which closely engages upper inner cylindrical surface 72 of torque mandrel 58, so that the inner ratchet threads 78 of ratchet blocks 76 are retained in engagement with the threaded portion 80 of ratchet mandrel 22 as long as ratchet blocks 76 are engaged with inner cylindrical surface 72.

When ratchet mandrel 22 is rotated clockwise relative to ratchet case 68, as viewed from above, the ratchet case 68 is moved downward relative to ratchet mandrel 22. When ratchet case 68 is moved downward a sufficient amount the threads 78 of ratchet block 76 move past a bottom thread 88, so that ratchet case 68 is not moved any further downward as ratchet mandrel 22 continues to rotate relative to ratchet case 68.

After the ratchet block 76 is moved out of engagement with the threaded portion 80, the ratchet block 76 is adjacent to the upper end of an enlarged inner diameter portion 90 of ratchet case 68. When ratchet blocks 76 are located within enlarged inner diameter portion 90, it is possible for ratchet blocks 76 to move radially outward relative to threaded portion 80 so that threaded portion 80 may be ratcheted downward relative to ratchet blocks 76 without rotation relative thereto when weight is set down upon ratchet mandrel 22.

Ratchet case 68 includes a bore 91 within which a lower end 94 of ratchet mandrel 22 is received. Sealing fluid tight engagement is provided between ratchet mandrel 22 and ratchet case 68 by means of a plurality of O-rings 92 disposed in annular grooves about an outer surface of ratchet mandrel 22 adjacent lower end 94. A radially inward projecting ledge 96 of ratchet case 68 engages lower end 94 of ratchet mandrel 22 to limit downward movement of ratchet mandrel 22 relative to ratchet case 68.

A lower end of ratchet case 68 includes an internal threaded portion 98 which threadedly engages an upper end of a release mandrel 100. Fluid tight sealing engagement between ratchet case 68 and release mandrel 100 is provided by means of O-rings 102.

The lower end of torque mandrel 58 is connected to a pump cam drive assembly 104 at threaded connection 106 (see FIG 1B). Cam drive assembly 104 is an annular shaped member including an annular lower cam drive surface 108 and an annular cam return groove 110. The cam groove 110 is parallel to the cam surface 108.

Engaging the cam surface 108 and cam groove 110 are four piston assemblies. Two of the piston assemblies, 112 and 116, are shown in FIG. 1B. The first piston 112 will be described. The other pistons are similarly constructed.

Piston assembly 112 includes inner and outer upper extensions 120 and 122 at its upper end. A cam-roller bearing 124 is mounted upon a cam follower pin 126 which spans inner and outer extensions 120 and 122.

A return follower bushing 128 is attached to a radially inward extension 130 of outer extension 122.

The cam-roller bearing rollingly engages cam surface 108 so as to drive the piston 112 downward as the low point of cam surface 108 moves past piston assembly 112. The return follower bushing 128 engages cam return groove 110 so as to pull piston assembly 112 upwards as the high point of cam groove 110 moves past the first piston assembly 112. This construction is similar to that shown in FIG. 16 of U.S. Pat. No. 3,439,740 to Conover.

A bearing retainer 132 is disposed about torque mandrel 58 and includes annular seal means 134 which provide sealing engagement between torque mandrel 58 and an upper inner bore 136 of bearing retainer 132.

Instead of the flat top shown on bearing retainer 132 of U.S. Pat. No. 4,246,964, however, bearing retainer 132 in FIG. 1A possesses a plurality of substantially identical upward-extending lugs 133 spaced 180° apart and having flat tops 135 and longitudinally extending flat sides 137.

An annular mandrel bushing 138 is closely received within an annular space between an outer surface 140 of torque mandrel 58 and an inner cylindrical surface 142, communicating with the lower end of bearing retainer 132.

The lower end of bearing retainer 132 includes an external threaded portion 144 which threadedly engages an upper inner portion of a piston housing 146.

Located between a lower end 148 of bearing retainer 132 and an upper end 150 of pump cam drive assembly 104 is a thrust bearing 152. The thrust bearing 152 carries the weight of those components suspended from piston housing 146.

A lower end of piston housing 146 is connected to a valve body 154 at threaded connection 156. A lower end of valve body 154 is connected to a valve casing 158 at threaded connection 160.

Returning now to the description of the components of the first piston assembly 112, a lower cylindrical portion 162 of piston assembly 112 is closely received within a cylinder sleeve 164, which cylinder sleeve 164 is disposed within an axial bore 166 of valve body 154 (see FIG. 1B). The other three piston assemblies are similarly received in cylinder sleeves 161, 163, and 165 in bores 167, 169 and 171.

Disposed about piston assembly 112 at the upper end of valve sleeve 164 and valve body 154 is a piston alignment sleeve 170.

The lower end of piston assembly 112 includes a reduced diameter axial extension 172 about which is disposed an annular sealing cup or wiper ring 174, which includes a lip for sealingly engaging cylinder sleeve 166. A retainer washer 176 is placed over the lower end of extension 172 and overlaps with wiper ring 174. A retaining bolt 178 threadedly engages an internal bore of extension 172 so as to hold retaining ring 176 and wiper ring 174 in place.

An annular O-ring seal 179 is disposed in an annular groove in the outer surface 162 of piston assembly 112 to provide a fluid tight sealing engagement between piston assembly 112 and cylinder sleeve 164.

The pump components located above O-ring seals 179 of the piston assemblies are bathed in lubricating fluid communicated from annular cavity 34 through annular cavity 177 located between release mandrel 100 and torque mandrel 58. This lubricating fluid is contained between the annular floating seal means 38 and the piston O-ring seals 179.

Cylinder sleeve 164 includes a lower inner bore 181. Associated with first piston assembly 112 are an inlet poppet valve and an outlet poppet valve assembly. Each of the three other piston asemblies also includes a separate inlet poppet valve and a separate outlet poppet valve.

On the left side of FIG. 1B a sectional elevation view of an inlet poppet valve assembly 182 is shown in conjunction with piston assembly 116. On the right side of FIG. 1B, a sectional elevation view of an outlet poppet valve assembly 184 is shown in conjunction with piston assembly 112. Inlet poppet valve assembly 182 includes an upper inlet poppet retainer assembly 186, an inlet poppet base member 188, and an inlet poppet spacer member 190. Inlet poppet retainer 186 includes a port means 192 therethrough which communicates with lower inner bore 180 of piston assembly 116. Inlet poppet base member 188 includes an inlet poppet seat 194 for sealingly engaging inlet poppet 196. An inlet poppet spring 198 engages inlet poppet 196 and a downward facing shoulder 200 of inlet poppet retainer assembly 186, so that inlet poppet 196 is resiliently urged into sealing engagement with inlet poppet seat 194.

Inlet poppet base 188 includes an inner bore 202 which communicates with inner bore 192 of inlet poppet retainer 186 when inlet poppet 196 is in the open position, i.e. when inlet poppet 196 is raised above inlet poppet seat 194.

Inlet poppet spacer member 190 includes an axial blind bore 204 communicating with bore 202 of inlet poppet base 188. Inlet poppet spacer member 190 also includes a radial bore 206 therethrough intersecting with axial bore 204. An annular groove 208 is located in the outer surface of spacer member 190 and also communicated with radial bore 206. Through annular groove 208 the radial bore 206 communicates with an annular cavity 210 located between a lower radially inner cylindrical extension 212 of valve body 154 and the outer surface of release mandrel 100.

As is further explained in U.S. Pat. No. 4,246,964, the annular cavity 210 communicates through a plurality of annular cavities with screen assembly 350 through which well fluid is drawn. The well fluid drawn through the screen and the annular cavities to the intake poppet valve assembly 182 is drawn into the inner bore of the cylinder sleeve 169 of piston assembly 116 on the upward intake stroke of piston 116. On the downward stroke of piston 116 the well fluid is forced through a second series of passages down to packers 440 and 662 as described below.

The operation of the outlet poppet valve will now be described with regard to the outlet poppet valve assembly 184 illustrated in conjunction with piston assembly 112.

Outlet poppet valve assembly 184 includes an outlet poppet valve base 214, an outlet poppet valve retainer assembly 216 and an outlet poppet valve spacer member 218.

Outlet poppet valve base 214, retainer assembly 216, and spacer member 218 include axial bores 220, 222, and 224, respectively.

An outlet poppet 226 is resiliently urged into sealing engagement with outlet poppet seat 228 by outlet poppet valve spring 230. When the piston assembly 112 is moving upwards on its suction stroke the outlet poppet 226 is held in sealing engagement against seat 228 by spring 230 so that fluid cannot flow through outlet poppet valve assembly 184 into the cylinder of piston assembly 112. During that intake stroke fluid is flowing into the cylinder of piston assembly 112 through an inlet poppet valve assembly disposed in valve bore **116*a* similar to inlet poppet valve assembly 182**.

On the downward stroke of piston assembly 112 fluid is forced from the cylinder 166 of piston assembly 112 downward through outlet poppet valve assembly 184 to an annular cavity 232 defined between valve casing 158 and a valve mandrel 234.

The valve mandrel 234 includes a radially outward projecting ledge 236, below which is located an outer cylindrical surface 238 of valve mandrel 234. Between cylindrical surface 238 and an inner cylindrical surface 240 of valve casing 158 there is defined an annular chamber 242 communicating with chamber 232. Within annular chamber 242 there is disposed a master outlet check valve assembly generally designated by the numeral 244. Master outlet check valve assembly 244 consists of a plurality of alternating annular sealing rings 246 and annular separator rings 248. The master outlet check valve assembly 244 provides a second check valve downstream of all of the outlet poppet valve assemblies 184 which prevents fluid from flowing back to the cylinders of the various piston assemblies from the packers which are located at a lower point on the drill string.

An annular cavity 250 is defined between an inner bore of valve mandrel 234 and an outer surface of release mandrel 100. Cavity 250 communicates with the cavity 210 located between valve body 154 and release mandrel 100.

Valve mandrel 234 includes a plurality of radially inward projecting splines 252 which mesh with a plurality of radially outward projecting splines 254 of release mandrel 100 so that relative axial movement between release mandrel 100 and valve mandrel 234 is permitted while rotational movement therebetween is prevented.

A lower end of valve casing 158 is connected to discharge adapter 256 at threaded connection 258 (see FIGS. 1B and 1C). A fluid tight seal is provided between valve casing 158 and discharge connector 256 by means of annular O-rings seals 260.

Discharge adapter 256 includes an upper axial extension 262 having a radially inward projecting flange 264 at the uppermost end thereof. The flange 264 engages and supports the lowermost annular sealing ring 246 of master outlet check valve assembly 244. A central axial bore 266 through flange 264 is closely received about outer cylindrical surface 238 of valve mandrel 234. The outer surface of axial extension 262 is spaced inward from inner cylindrical surface 240 of valve casing 158 so as to define an annular chamber 268 therebetween. Annular chamber 268 communicates with the annular chamber 242 between valve mandrel 234 and valve casing 158.

Axial extension 262 of discharge adapter 256 includes an axial bore 270 which is spaced radially outward from outer surface 238 of valve mandrel 234 so as to define an annular chamber 272 therebetween. The annular chamber 272 is communicated with the annular chamber 268 by means of a plurality of radial bores 274 disposed through axial extension 262.

Discharge adapter 256 includes a plurality of longitudinal bores 276. A short radial bore 278 communicates longitudinal bore 276 with annular cavity 272. The lower end of bore 276 communicates with a downward facing shoulder 280 of discharge adapter 256 (see FIG. 1C).

An annular cavity 282 is defined between inner cylindrical surface 284 of discharge adapter 256 and an outer cylindrical surface 286 of a relief housing 288. Relief housing 288 is threadedly connected to discharge adapter 256 at threaded connection 290 located above downward facing shoulder 280.

A radial bore 292 is disposed through relief housing 288 and communicates cavity 282 with an inner annular recess 294 of relief housing 288.

An inner cylindrical surface 296 of relief housing 288 includes a plurality of annular grooves which contain a pair of upper O-ring seals 298 and a pair of lower O-ring seals 300, which provide fluid tight sealing engagement between inner cylindrical surace 296 and the outer surface of release mandrel 100 above and below annular groove 294.

When release mandrel 100 is in a first position as illustrated in FIG. 1C, a relief port 302, disposed through the wall of release mandrel 100 communicates with annular groove 294 of relief housing 288 so as to provide fluid communication between annular groove 294 and inner bore 30 of release mandrel 100. When the relief port 302 is in registry with inner annular recess 294, thereby providing communication of the exhaust fluid from the pumping system to the inner bore 30, the discharge pressure of the pumping system is relieved into the inner bore 30 and it is not possible for the packers located below relief bore 302 to be inflated.

When it is desired to inflate the packers, the ratchet mandrel 22 is rotated relative to the ratchet case 68 so that the ratchet blocks 76 cause the release mandrel 100 to be moved axially downwards to a second position relative to relief housing 288 and relief port 302 is moved downward out of communication with annular recess 294 so that there is no longer communication between recess 294 and the inner bore 30 of release mandrel 100.

The ratchet blocks 76, the threaded outer surface 80 of ratchet mandrel 22, and inner cylindrical surfaces 72 and 90 of torque mandrel 58 may be generally characterized as a screw jack means for moving release mandrel 100 from its said first position to its said second position upon relative rotational movement between ratchet mandrel 22 and ratchet case 68.

Enlarged diameter inner surface 90 of torque mandrel 58 serves as a release means for disengaging ratchet blocks 76 from ratchet mandrel 22 after release mandrel 100 is moved to its said second position.

Radial bore 292 also communicates with the upper end of a longitudinal bore 304 disposed in relief housing 288. The lower end of longitudinal bore 304 communicates with a downward facing shoulder 306 of relief housing 288.

Relief housing 288 includes a second longitudinal blind bore 308 having an upper end communicating with annular cavity 250. A lower blind end 309 of second bore 308 communicates with a second radial bore 310 which communicates with an outer cylindrical surface 312 of relief housing 288.

The lower end of discharge adapter 256 is threadedly connected to a suction nipple 314 at threaded connection 316. The lower end of suction nipple 314 is threadedly connected to a lower adapter 318 at threaded connection 320.

The lower end of relief housing 288 is threadedly connected to an inner receiver 322 at threaded connection 324.

Suction nipple 314 includes a longitudinal bore 326, the upper end of which is communicated with radial bore 310 of relief housing 288 by radial bore 328. The lower end of longitudinal bore 326 communicates with a downward facing shoulder 330 of suction nipple 314.

Downward facing shoulder 330 is longitudinally spaced a short distance from an upward facing shoulder 332 of lower adapter 318 so as to define an annular cavity 334 between said downward and upward facing shoulders 330 and 332.

Annular cavity 334 communicates with a bore 336 of lower adapter 318, which bore 336 is slightly skewed from a longitudinal axis of lower adapter 318. The lower end of bore 336 communicates with a lower end surface 338 of lower adapter 318.

The downward facing shoulder 306 of relief housing 288 is longitudinally spaced a short distance from an upward facing shoulder 338 of suction nipple 314 so as to define an annular cavity 340 therebetween. Annular cavity 340 communicates with an annular space 342 defined between an outer surface 344 of inner receiver 322 and an inner surface 346 of suction nipple 314. The annular cavity 342 in turn communicates with an annular cavity 348 defined between the outer surface 344 of inner receiver 322 and an inner surface of lower adapter 318.

Referring now to FIGS. 3A–3C and 4 of the drawings, the preferred embodiment of safety joint 800 comprises upper adapter 802 having substantially uniform cylindrical exterior 804 (with flats, unnumbered, at its lower end). The interior of upper adapter 800 comprises entry wall 806, followed by frustoconical surface 808 which leads to box threads 810. Box threads 810 terminate at lower wall 812, which extends to frustoconical surface 814, leading radially inward to cylindrical surface 816, followed by outwardly extending radially flat surface 818. Surfaces 814, 816, and 818 define annular abutment 820 on the interior of upper adapter 802. Cylindrical interior surface 822 having threads 824 thereon leads to the lower end of upper adapter 802.

Mandrel connector 830 possesses threads 832 on its upper exterior surface, which threads 832 engage threads 824 on upper adapter 802, and are made up therewith until upper end 834 of mandrel connector 830 contacts annular abutment 820. Below threads 832, a pair of O-rings 836 in annular grooves 838 in the exterior of mandrel connector 830 provide a fluid-tight seal between upper adapter 802 and mandrel connector 830. The upper interior of mandrel connector 830 has interior threads 840 thereon, followed by radially flat wall 842 leading inwardly to cylindrical interior surface 844, which extends to radially flat wall 846 leading outwardly to threaded surface 848, which extends to the lower end of mandrel connector 830. The lower end of mandrel connector 830 comprises radially flat annular surface 850.

Mandrel 860 is secured to threads 848 of mandrel connector 830 by threads 862. Below threads 862, a pair of O-rings 864 in annular grooves 866 provide a fluid-tight seal between mandrel connector 830 and mandrel 860. Below annular grooves 866, the exterior of mandrel 860 comprises upper cylindrical surface 868 from which spline 870 extends radially outward. Below the end of spline 870, tapered annular surface 872 leads outwardly to cylindrical plateau 874, which extends to recessed area 876 from which J-slot lug 878 protrudes above cylindrical plateau. Spline 870 and J-slot lug 878 are substantially circumferentially aligned. Below plateau 874, tapered annular surface 880 leads inwardly to lower cylindrical surface 882, which is pierced by a plurality of inner relief ports 884 which extend through the wall of mandrel 860 to substantially cylindrical inner surface 886. Mandrel 860 terminates on its exterior at lower end with an annular stop leading to thread 888, the diameter of thread 888 being less than that of lower cylindrical surface 882.

Figure 4:
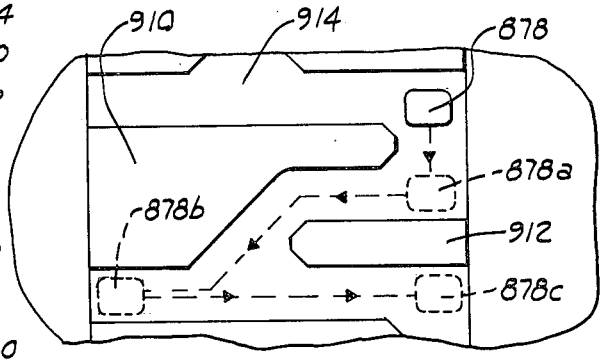
FIG. 4 is a 180° outside development of the automatic J-slot employed within the housing of the safety joint of the present invention.

Housing 900 surrounds mandrel 860 and comprises at its top end case 902 having substantially uniform cylindrical exterior 904, with a plurality of outer relief ports 906 extending through the wall thereof to substantially uniform cylindrical bore wall 908. A plurality of J-slot islands 910 and 912 (see FIG. 4) protrude inwardly from bore wall 908 around its inner circumference, defining automatic J-slot 914. The preferred embodiment possesses two substantially identical islands 910 and two substantially identical islands 912, the configurations of which are shown in FIG. 4 and will be dealt with further in conjunction with the operation of the preferred embodiment of the safety joint 800 of the present invention.

Above J-slot 914 on the interior of case 902, left-hand threads 916 are cut into bore wall 908. Below J-slot 914, standard right-hand threads 918 are cut into bore wall 908.

Figure 3A:
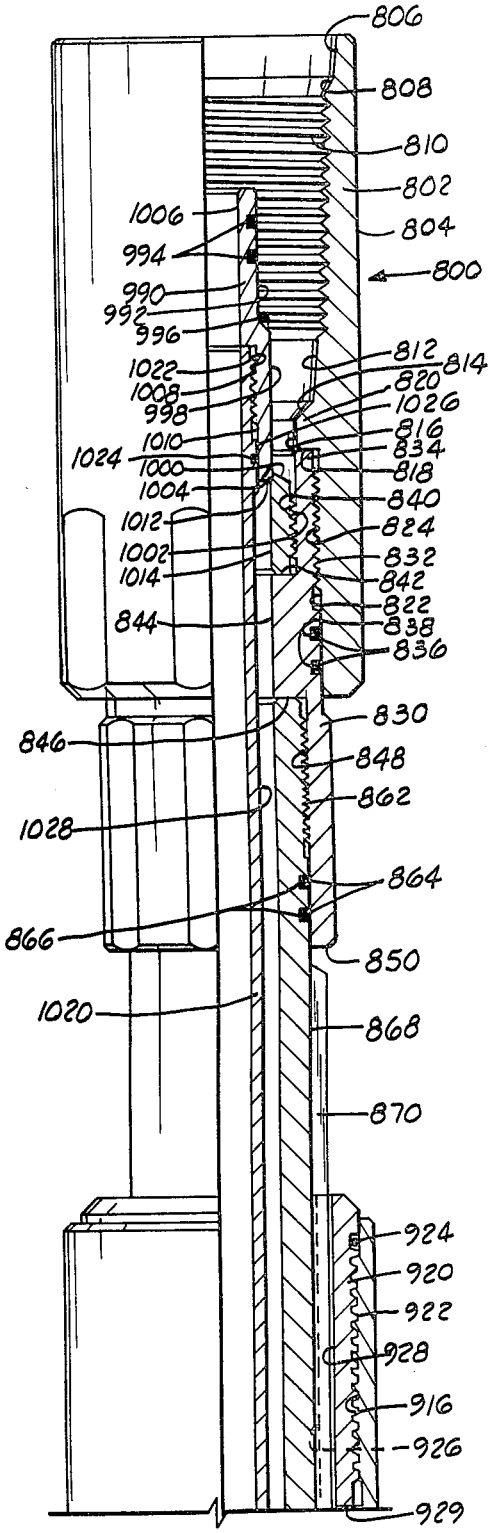
FIGS. 3A, 3B and 3C are vertical half-sectional elevations of the safety joint of the present invention.
Figure 3B:
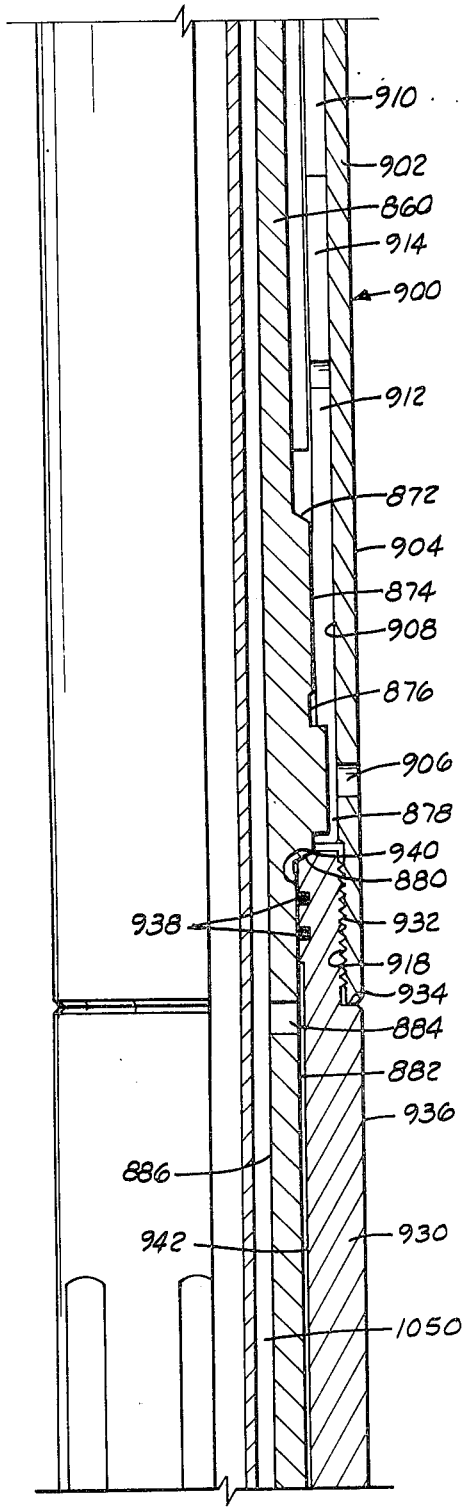
Figure 3C:
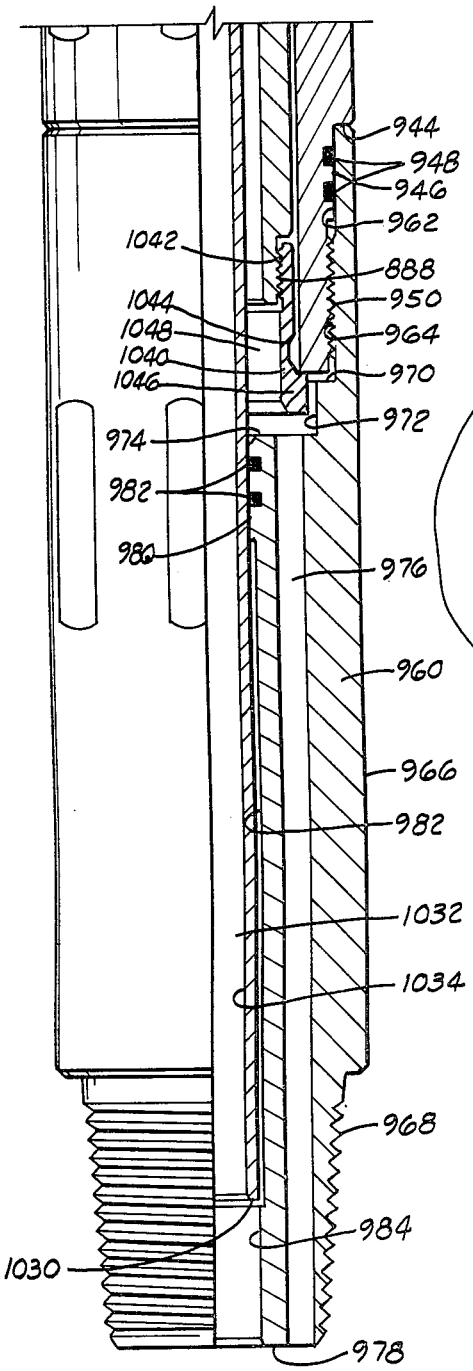

Tubular mandrel retainer nut 920 having left-hand threads 922 on the exterior thereof is shown threaded into case 900 in FIG. 3A. O-ring 924 provides an initial seal between case 900 and nut 920 to prevent grit and debris-laden well fluids from hindering the initial back-off of nut 920 during operation of the safety joint. Nut 920 possesses a cylindrical bore defined by bore wall 926, onto which longitudinally oriented keyway 928 opens throughout the entire length of nut 920. The lower end of nut 920 is defined by radially flat annular wall 929.

Connector 930 is secured to threads 918 of case 902 by threads 932. Case 902 is made up to connector 930 until the former's lower end abuts annular shoulder 934 on the latter. The exterior of connector 930 comprises substantially cylindrical surface 936 (having flats thereon) of substantially the same diameter as surface 904. A fluid-tight seal is achieved between connector 930 and lower cylindrical surface 882 of mandrel 860 by O-rings 938 disposed in annular grooves (unnumbered) in the interior of connector 930. Below O-ring seal surface 940, the inner diameter of connector 930 increases in a short step to bore wall 942, which extends to the lower end of connector 930. At the lower outer extent of connector 930, radially flat annular shoulder 944 drops inwardly to seal surface 946, which possesses annular grooves therein containing O-rings 948. Below seal surface 946, exterior threads 950 lead to the end of connector 930.

O-rings 948 achieve a fluid-tight seal between seal surface 946 and undercut surface 962 of lower adapter 960, interior threads 964 mating with exterior threads 950 on connector 930. The exterior of lower adapter 960 comprises a cylindrical surface 966 of substantially the same diameter as surfaces 904 and 936; the lower exterior end of lower adapter 960 comprises pin thread 968. Below threads 964, radially flat annular step 970 leads inwardly to tension sleeve bore wall 972, which in turn is terminated at annular radially flat passage wall 974, which is pierced by a plurality of longitudinal packer fluid bores 976 leading to the bottom end 978 of lower adapter 960. Immediately below passage wall 974 on the interior of lower adapter 960, lies mandrel seal surface 980 having grooves cut therein, in which O-rings 982 are disposed. Below mandrel seal surface 980, the bore of lower adapter 960 increases slightly at bore wall 982, which extends to a short annular step proximate the end of lower adapter 960, where the bore is narrowed again at end bore wall 984.

Referring again to the top end of safety joint 800 and in particular FIG. 3A, seal mandrel 990 possesses exterior cylindrical seal surface 992 with O-ring seals 994 therein at its top end. First tapered annular edge 996 leads outwardly to intermediate surface 998, also of cylindrical configuration. Second tapered annular edge 1000 leads outwardly to threaded cylindrical surface 1002, which is secured to threads 840 of mandrel connector 830, the lower end of seal mandrel 990 abutting wall 842. A plurality of oblique packer fluid passages 1004 extend through second tapered edge 1000 to the interior of seal mandrel 990. The interior of seal mandrel 990 comprises cylindrical upper bore wall 1006 at its top end, terminating in a radially flat annular face extending outwardly to threaded interior surface 1008 having smooth mandrel seal surface 1010 therebelow. Below mandrel seal surface 1010, annular wall 1012 extends radially outwardly to cylindrical bore wall 1014. Oblique packer fluid passages 1004 pierce wall 1012.

Flow tube 1020 extends substantially from seal mandrel 990 to end bore wall 984 of lower adapter 960. Flow tube 1020 is secured to threaded surface 1008 of seal mandrel 990 by threads 1022. O-ring seal 1024 in an annular groove on the exterior of flow tube 1020 creates a fluid-tight seal between seal surface 1026 of flow tube 1020 and mandrel seal surface 1010 on seal mandrel 990. A slight inwardly annular tapered edge leads from seal surface 1026 to smooth cylindrical flow tube surface 1028, which extends substantially to the lower end 1030 of flow tube 1020. The interior bore 1032 of flow tube 1020 is substantially uniform and defined by bore wall 1034. A substantially fluid-tight seal is achieved between lower adapter 960 and flow tube 1020 by seals 982. Annular packer fluid passage 1050 is defined by the interior of mandrel 860 and the exterior of flow tube 1020.

Tension sleeve 1040 has interior threads 1042 at its top end, which threads engage threads 888 on mandrel 860. The exterior of tension sleeve 1040 possesses annular area 1044 of reduced wall thickness, below which annular shoulder 1046 extends outwardly beyond the diameter of bore wall 942 of connector 930 in the area defined by tension sleeve bore wall 972 of lower adapter 960. The interior of tension sleeve 1040 and the exterior of flow tube 1020 define annular packer fluid passage 1048. All of the metallic components of the safety joint 800 are normally made of steel, including tension sleeve 1040, which has a precalculated tensile strength based on its wall thickness to assure parting of the sleeve at area 1044 at a predetermined upward force on the pipe string.

J-slot 914 is defined, as noted above, by islands 910 and 912. FIG. 4 depicts 180° outside view of J-slot 914, one full island 910 and one full island 912. J-slot lug 878 is depicted in solid lines in the position shown in FIG. 3A. Reference numerals 878*a*, 878*b* and 878*c* depict various positions of J-slot lug 878 as it moves during the operation of safety joint 800.

In describing the operation of the longitudinal passages in safety joint 800 with respect to pump assembly 10, screen assembly 350 and packers 440 and 662 as described in my U.S. Pat. No. 4,246,964, packer inflation fluid from pump assembly 10 which travels through screen assembly 350, enters safety joint 800 at upper adapter 802 and travels downward to packer fluid annulus 1050 through oblique packer fluid passages 1004 in seal mandrel 990; the bottom of packer fluid annulus 1050 communicates through annular packer fluid passage 1048 with packer fluid bores 976 terminating at bottom end 978 of lower adapter 960. Fluid passages 976 in turn communicate with upper packer assembly 440, whereby inflation fluid is communicated to and from packer assemblies 440 and 662 in the manner described in my U.S. Pat. No. 4,246,964.

Referring now to FIGS. 1A, 3A–3C and 4 of the drawings, safety joint 800 is operated by the reciprocation and right-hand rotation of pipe string 15. Assuming for the purposes of illustration that the portion of the well testing assembly below safety joint 800 is stuck in the well bore, either due to non-deflation of the packers 440 and 662 or for another reason, the operator sets down pipe string 15 so that torque mandrel 58 and release mandrel 100 secured to upper pump portion 11 telescope downward into lower pump portion 13, so that lugs 53 on flange 52 of torque housing 48 engage lugs 133 on bearing retainer 132, preventing rotation of the upper and lower pump portions 11 and 13 with respect to one another. The operator then applies right-hand torque to pipe string 15, which applies a right-hand rotational force to mandrel 860, which is keyed to nut 920 by spline 870 in keyway 928. This force causes nut 920 (which is left-hand threaded) to back off from case 902, permitting J-slot lug 878 to move 90° circumferentially in J-slot 914 to position 878*a*. The operator then lifts up on pipe string 15 with the derrick from which pipe string 15 is suspended, to create sufficient tension to shear tension sleeve 1040 at area 1044. Parting of tension sleeve 1040 permits mandrel 860 and flow tube 1020 to move upward with respect to housing 900. This upward movement is ultimately limited by contact of mandrel surface 872 with the lower end of nut 920. However, prior to contacting wall 929, J-slot lug 878 encounters an island 910 defining J-slot 914, which encounter exerts a right-hand rotational force on J-slot lug 878. As noted before, mandrel 860 is keyed to nut 920 by spline 870 in keyway 928, so that this right-hand rotational force also acts upon nut 920, causing its threads 916 to back off from threads 922 of case 902, thereby allowing J-slot lug 878 to move 90° circumferentially to position 878*b* in J-slot 914. The operator then sets down weight on pipe string 15, causing mandrel 860 and flow tube 1020 to telescope back into housing 900, J-slot lug 878 moving back down to position 878*c* as shown in FIG. 4, which is identical to position 878 but 180° opposite thereto around the circumference of case 902. Thus, nut 920 has been backed off one-half turn from case 902. The sequence of setting down, followed by right-hand rotation, then picking up pipe string 15, is repeated until nut 920 is backed all the way out of case 902, whereupon J-slot lug 878 is no longer limited in its upward travel and mandrel 860 and flow tube 1020 pull free, allowing pipe string 15, pump 10, screen 350, and upper adapter 802, mandrel connector 830, mandrel 860, mandrel retainer nut 920, seal mandrel 990 and flow tube 1020 to be withdrawn from the well bore.

It should be noted that the parting of tension sleeve 1040 may be all that is necessary to release pipe string 15, the entire downhole pump assembly and related components from the well bore. This is due to the packer relief feature built into safety joint 800. As tension sleeve 1040 parts, and mandrel 860 moves upward, inner relief ports 884 on mandrel 860 pass O-rings 938 and permit fluid communication between packer fluid annulus 1050 between mandrel 860 and flow tube 1020 and outer relief ports 906 in case 902, through the annular area between mandrel 860 and case 902. Thus, if the pipe string and testing assembly is stuck in the well bore through contact of inflated packers 440 and 662 with well bore wall 19, and the mechanism in pump 10 to release the fluid previously pumped into the packers should malfunction, or the relief ports associated with pump 10 should clog, the packer fluid can be relieved through safety joint 800. However, if this relief procedure does not result in the freeing of the pipe string and testing assembly, backing off nut 920 can still be effected, and the pump, screen and upper portion of the safety joint removed from the well bore.

While the present invention has been disclosed in terms of a preferred embodiment, it will be appreciated by one of ordinary skill in the art that additions, deletions and modifications to the invention may be made without departing from the spirit and scope of the invention as defined by the claims that follow. For example, the lug may be on the inner wall of the housing and the slot may be in the mandrel; the retainer nut may be at the end of the housing and not contained within it; the retainer nut could overshoot the end of the housing on its exterior and be threaded on the interior of the overshot portion, with the housing threaded thereto on its exterior; the spline could be placed on the retainer nut and the lug may cut into the mandrel; the tension sleeve might be of other than tubular configuration.

I claim:

1. A method of operating a safety joint in a pipe string including a rotary actuated pump in a well bore, comprising:

(a) setting down on said pipe string and locking said rotary actuated pump against rotation;

(b) applying torque to said safety joint through said locked pump;

(c) pulling substantially upward on said pipe string with sufficient force to sever a tension sleeve means in said safety joint;

(d) setting down on said pipe string and locking said rotary actuated pump against rotation;

(e) applying torque to said safety joint through said locked pump;

(f) pulling substantially upward on said pipe string; and (g) repeating steps (d), (e) and (f) a plurality of times until said safety joint separates.

2. The method of claim 1, further including backing off a retainer nut means through said application of torque and substantially upward pulling, whereby said safety joint separates.

3. The method of claim 2, wherein said backing off is effected by manipulating a lug means in a slot means in said safety joint.

4. The method of claim 3, wherein said lug means is rotated and moved upward and downward in said slot means.

5. The method of claim 1, further including opening the interior of said safety joint to the surrounding well bore.

6. The method of claim 5, wherein said step of opening is effected by said step of pulling substantially upward on said pipe string with sufficient force to sever said tension sleeve means.

7. A safety joint for use in a pipe string in a well bore, comprising:

substantially tubular housing means having left-hand threads on the interior wall thereof;

retainer nut means associated with said housing means having left-hand exterior threads thereon mated with said housing means threads and a bore therethrough having a longitudinally extending radial keyway means opening thereinto;

mandrel means having longitudinally extending radial spline means thereon slidably disposed within said retaining nut means, with said spline means in said keyway means;

tension sleeve means adapted to prevent substantial longitudinal movement between said mandrel means and said housing means prior to the application of a predetermined tensile force to said tension sleeve means; and lug means and cooperating slot means, one associated with said housing means and the other with said mandrel means, said lug means and said slot means adapted to cause said retainer nut means to rotate with respect to said housing means in response to a right-hand torque applied to said mandrel means when said mandrel means and said housing means are telescoped substantially together, said application of right-hand torque being followed by an initial application through said pipe string of a tensile force to said mandrel means in excess of that required to part said tension sleeve means, and a subsequent plurality of repetitions of said application of right-hand torque when said mandrel means and said housing means are telescoped substantially together followed by substantially upward reciprocation of said mandrel means with respect to said housing means, whereby said retainer nut means is backed off completely from said housing means and said mandrel is released therefrom.

8. The safety joint of claim 7, wherein said lug means comprises a lug on said mandrel below said spline means, and said slot means comprises an automatic J-slot on the interior of said housing means below said left-hand threads.

9. The safety joint of claim 8, wherein said automatic J-slot comprises at least one substantially longitudinal channel on the interior of said housing, and at least one substantially lateral channel on the interior of said housing, said lateral channel having a first circumferentially oriented portion, a second longitudinally oriented portion and a third obliquely oriented portion, said first portion communicating with a lower portion of said at least one longitudinal channel and said third portion communicating with an upper portion of said at least one longitudinal channel.

10. The safety joint of claim 9, wherein said at least one substantially longitudinal channel comprises two substantially diametrically opposed longitudinal channels, and said at least one substantially lateral channel comprises two substantially lateral channels, each of said substantially lateral channels extending from a lower portion of one of said longitudinal channels to an upper portion of the other of said longitudinal channels.

11. The safety joint of claim 10, wherein said mandrel means comprises an outer mandrel and a substantially coaxial inner mandrel defining a substantially annular channel therebetween, said inner mandrel having a substantially axial bore therein.

12. The safety joint of claim 11, wherein said housing means further includes a lower channel means therein in communication with said annular channel, and a lower bore in communication with said inner mandrel axial bore.

13. An apparatus for the release of an upper portion of a pipe string in a well bore from a lower portion which is stuck in said well bore, comprising:

a rotary actuated pump having an upper pump portion and a lower pump portion in telescoping relationship, each of said pump portions having lug means thereon adapted to lock together with the lug means on the other pump portion when said upper and lower pump portions are telescoped substantially together; and a safety joint including housing means and mandrel means below said rotary actuated pump and adapted to back off a retainer nut means associated therewith in response to a plurality of sequential applications of torque to said pipe string when said pump portions are telescoped together followed by substantially upward movement of said pipe string, whereby said mandrel means is released from said housing means and said upper portion of said pipe string including said mandrel means is released from said lower portion of said pipe string.

14. The apparatus of claim 13, wherein said safety joint further includes cooperating lug means and slot means on said mandrel means and said housing means.

15. The apparatus of claim 14, wherein said lug means comprises a lug on said mandrel and said slot means comprises a slot on the inner wall of said housing.

16. The apparatus of claim 15, wherein said slot comprises an automatic J-slot including at least one substantially longitudinal channel on the interior of said housing and at least one substantially lateral channel on the interior of said housing, said lateral channel having a first circumferentially oriented portion, a second longitudinally oriented portion and a third obliquely oriented portion, said first portion communicating with a lower portion of said at least one longitudinal channel and said third portion communicating with an upper portion of said at least one longitudinal channel.

17. The apparatus of claim 16, wherein said at least one longitudinal channel comprises two substantially diametrically opposed substantially longitudinal channels, and said at least one substantially lateral channel comprises two substantially lateral channels, each of said substantially lateral channels extending from a lower portion of one of said longitudinal channels to an upper portion of the other of said longitudinal channels.

18. The apparatus of claim 17, wherein said mandrel means comprises an outer mandrel and a substantially coaxial inner mandrel defining a substantially annular channel therebetween, said inner mandrel having a substantially axial bore therein.

19. The apparatus of claim 18, wherein said housing means further includes a lower channel means therein in communication with said annular channel, and a lower bore in communication with said inner mandrel axial bore.

20. The apparatus of claim 19, further including tension sleeve means adapted to prevent substantial longitudinal movement between said mandrel means and said housing means prior to the application of a predetermined tensile force thereto through said pipe string.

* * * * *